US005547816A

United States Patent [19]

Fyson et al.

[11] Patent Number: 5,547,816

[45] Date of Patent: Aug. 20, 1996

[54] PHOTOGRAPHIC PROCESSING METHOD USING BLEACH SOLUTION COMPRISING HYDROGEN PEROXIDE AND HALIDE IONS

[75] Inventors: John R. Fyson, Hackney; Peter D. Marsden, North Harrow, both of Great Britain

[73] Assignee: Eastman Kodak Company, Rochester, N.Y.

[21] Appl. No.: 389,731

[22] Filed: Feb. 15, 1995

Related U.S. Application Data

[63] Continuation of Ser. No. 229,397, Apr. 15, 1994, abandoned, which is a continuation of Ser. No. 861,966, Jun. 18, 1992, abandoned.

[30] Foreign Application Priority Data

Oct. 19, 1990 [GB] United Kingdom ..... 9022749

[51] Int. Cl.[6] ..... G03C 7/00; G03C 5/44; G03C 5/22; G03C 7/26

[52] U.S. Cl. ..... 430/393; 430/943; 430/367; 430/373; 430/430; 430/432; 430/461

[58] Field of Search ..... 430/393, 943, 430/461, 367, 373, 430, 432

[56] References Cited

U.S. PATENT DOCUMENTS

| | | | |
|---|---|---|---|
| 2,338,662 | 1/1944 | Muehler | 430/943 |
| 2,338,663 | 1/1944 | Muehler | 430/943 |
| 4,045,225 | 8/1977 | Shimamura et al. | 430/943 |
| 4,057,427 | 11/1977 | Enriquez | 430/943 |
| 4,069,050 | 1/1978 | Hara et al. | 430/943 |
| 4,277,556 | 7/1981 | Koboshi et al. | 430/393 |
| 4,301,236 | 11/1981 | Idota et al. | 430/393 |
| 4,454,224 | 6/1984 | Brien et al. | 430/943 |
| 4,717,649 | 1/1988 | Hall et al. | 430/943 |
| 4,737,450 | 4/1988 | Hall et al. | 430/943 |
| 4,880,725 | 11/1989 | Hirai et al. | 430/943 |

FOREIGN PATENT DOCUMENTS

| | | |
|---|---|---|
| 428101 | 5/1991 | European Pat. Off. . |
| 8706361 | 10/1987 | WIPO . |

*Primary Examiner*—Charles L. Bowers, Jr.
*Assistant Examiner*—J. Pasterczyk
*Attorney, Agent, or Firm*—J. Lanny Tucker

[57] ABSTRACT

A method of photographic color processing which comprises a bleach step wherein the bleach solution comprises hydrogen peroxide, or a compound which releases hydrogen peroxide, and halide ions and which has a pH in the range of 5 to 11 and bleach solutions therefore.

7 Claims, 1 Drawing Sheet

Figure 1:
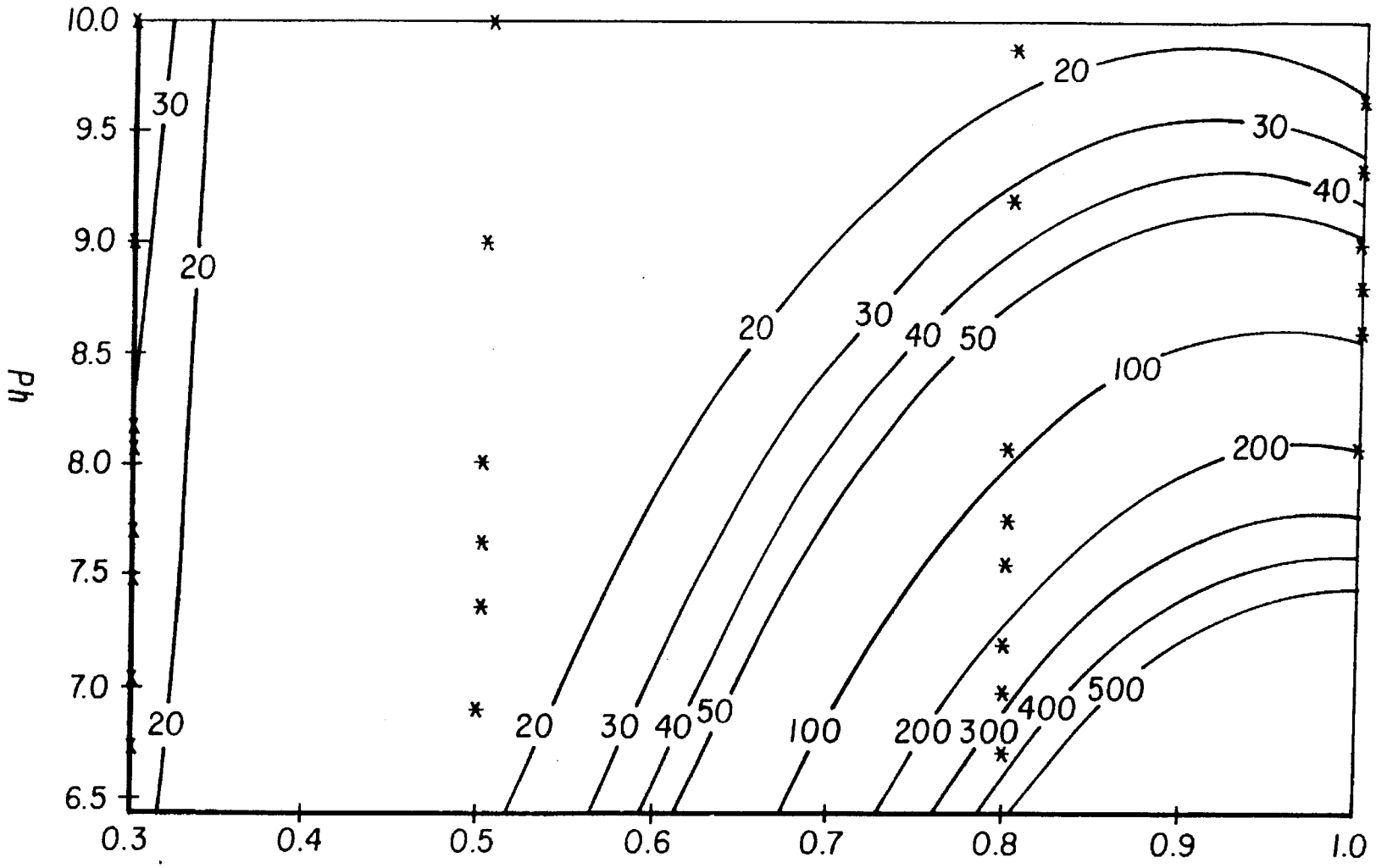

PHOTOGRAPHIC PROCESSING METHOD USING BLEACH SOLUTION COMPRISING HYDROGEN PEROXIDE AND HALIDE IONS

This application is a continuation of application Ser. No. 08/229,397 filed Apr. 15, 1994, and now abandoned which is itself a continuation of application Ser. No. 07/861,966, filed Jun. 18, 1992 and now abandoned.

This invention relates to photographic bleach compositions for use in photographic colour processing.

There are a number of proposals in the art to use peroxy compounds, e.g. hydrogen peroxide or a compound capable of releasing hydrogen peroxide, in bleach compositions in conventional colour processes. In U.S. Pat. No. 4,277,556 there are described bleach solutions consisting of some 50 ml/l 30% hydrogen peroxide solution and 30 ml/l concentrated acetic acid. Such solutions however do not bleach the entire amount of silver present. U.S. Pat. No. 4,454,224 describes an improvement on the above in which the bleach solution further contains a polyacetic acid and is alkaline having a pH of 7 or more. Other peroxide bleach solutions must contain an organic metal complex salt, e.g. U.S. Pat. No. 4,301,236, while others must employ a bleach accelerator e.g., Japanese specifications 611250647A and 611261739A. In spite of all these suggestions no such solution has ever been used commercially.

In our previous (unpublished) application (reference 5353) there is described a hydrogen peroxide-based bleach solution useful for bleaching photographic silver images. It has since been observed, however, that this bleach solution is sensitive to developer components carried over from the previous baths and to halide ions which may also be carried over or may be released by the photographic material being processed. A further disadvantage is that decomposition of the peroxide can occur within the gelatin of the photographic material causing surface damage.

The objective of the present invention is to provide a bleach solution which overcomes these difficulties.

Another objective of the present invention is to produce a bleach solution whose effluent is much more environmentally acceptable than currently used bleaches which contain ferricyanides or EDTA-type metal complexing agents and their complexes with, say, iron.

According to the present invention there is provided a photographic bleach solution comprising hydrogen peroxide, or a compound which releases hydrogen peroxide, and halide ions and which has a pH in the range of 5 to 11, preferably 5 to 10.

The halide ions are preferably chloride. The time of treatment in the present bleach solution is preferably more than 20 seconds, especially in the range 20 to 40 seconds. Thus the preferred time of treatment in the bleach bath is in the range 20 to 40 seconds.

Preferably the bleach solution has an alkali or buffer to maintain the pH within the stated range. Examples of suitable materials include an alkali metal carbonate or a carbonate/hydrogen carbonate buffer, a phosphate buffer or an amine/borate buffer.

The relationship between the halide ion concentration and the pH is important and this relationship is shown in FIG. 1 of the accompanying drawings which is a plot of lines of equal processing time on a pH versus potassium chloride concentration graph. The area to the left of the 20 second line is not the preferred area to work within as bubble formation and damage to the gelatin layers can occur. The preferred area is that lying between the 20 second line and the 40 second line.

The bleach solutions of the present invention may be used with any type of photographic silver halide colour material. Such materials and their possible constituents are described, for example, in Research Disclosure Item 308119, December 1989 published by Kenneth Mason Publications, Emsworth, Hants, United Kingdom. However, materials based on predominantly silver chloride emulsions are preferred.

The present invention also provides a method of photographic colour processing which comprises a bleach step wherein the bleach solution comprises hydrogen peroxide, or a compound which releases hydrogen peroxide, and halide ions and which has a pH in the range of 5 to 11, preferably 5 to 10.

The bleach step may directly follow the developing or redox amplification stages or an intermediate stop bath may be employed. An important consideration is whether unexposed (Dmin) areas produce unwanted dye by oxidation of developing agent carried over into the bleach bath. In both Examples below there is no significant increase in Dmin even though no stop bath was used.

In one embodiment of the present invention the bleach solution may be used after a redox amplification step. Redox amplification processes have been described, for example in British Specification Nos. 1,268,126, 1,399,481, 1,403,418 and 1,560,572. In such processes colour materials are developed to produce a silver image (which may contain only small amounts of silver) and then treated with a redox amplifying solution (or developer-amplifier) to form a dye image. The redox amplifying solution contains a reducing agent, for example a colour developing agent, and an oxidising agent which will oxidise the colour developing agent in the presence of the silver image which acts as a catalyst. The photographic material used in such a process may be a conventional coupler-containing silver halide material or an image transfer material containing redox dye releasers. Oxidised colour developer reacts with a colour coupler (usually contained in the photographic material) to form image dye. The amount of dye formed depends on the time of treatment or the availability of colour coupler rather than the amount of silver in the image as is the case in conventional colour development processes. Examples of suitable oxidising agents include peroxy compounds including hydrogen peroxide, cobalt (III) complexes including cobalt hexaammine complexes, and periodates. Mixtures of such compounds can also be used. A particular application of this technology is in the processing of silver chloride colour paper, especially such paper with low silver levels, for example at levels of total silver halide coverage below 200 mg/m$^2$, preferably below 160 mg/m$^2$ and especially 140 mg/m$^2$ (as silver).

In this embodiment of the invention the photographic material to be processed preferably contains low levels of silver and is preferably based on emulsions which comprise at least 80%, preferably at least 90% silver chloride and especially substantially pure silver chloride.

The following Examples are included for a better understanding of the invention.

EXAMPLE 1

A redox amplification bath was made up as follows:

| | |
|---|---|
| Potassium carbonate | 25.0 g |
| 1-Hydroxyethylidene-1,1-diphosphonic acid | 0.6 g |
| Diethylhydroxylamine | 5.0 g |
| Potassium chloride | 0.35 g |
| CD3 (colour developing agent) | 3.5 g |
| Hydrogen peroxide 30% | 5.0 g |
| Water to | 1.0 liter. |
| pH = 10.3 | |

A bleach solution was made up as follows:

| | |
|---|---|
| Potassium hydrogen carbonate | 25.0 g |
| Potassium chloride | 0.3–1.0 g |
| Hydrogen peroxide 30% | 50.0 g |
| Water to | 1.0 liter |

pH Values were adjusted to between 5 and 10 using potassium carbonate or sulphuric acid as required.

A colour photographic paper comprising silver chloride emulsions and a total silver coverage of about 140 mg/m$^2$ was exposed to white light for 10 seconds and then developed for 45 seconds at 35° C. The paper was then immersed in the bleach solution and the silver loss followed by observing the transmitted infra-red density. The time of bleaching was taken as the time taken to reach a point at which the density no longer changed. The results are shown in FIG. 1 of the accompanying drawings in which pH and KCl content are plotted as "*". Samples of some runs where bleaching took place in less than 45 seconds were analysed and the residual silver was found to be less than 2 mg/m$^2$ thus confirming that effective bleaching had taken place.

We have derived the following empirical equation for bleach time:

$$\textit{Bleach time}=\exp\,(7-42\times[KCl]+0.8\times pH-2.2\times[KCl]\times pH+97.3\times[KCl]^2-45.4\times[KCl]^3)\ \textit{secs.}$$

The units for the concentrations shown in brackets are g/liter. The curves on FIG. 1 were drawn using this equation.

EXAMPLE 2

A bleach solution was made as follows:

| | |
|---|---|
| Potassium hydrogen carbonate | 25.0 g |
| Potassium chloride | 5.0 g |
| Hydrogen peroxide 30% | 100.0 g |
| Water to | 1.0 liter |
| pH adjusted to 10. | |

A piece of conventional silver chloride-based photographic colour paper (containing a total silver coverage of 700 mg/m$^2$) was exposed to room light for 10 seconds, developed for 45 seconds in a conventional colour developer and plunged into the bleach solution. The silver loss was followed as described above. Bleaching was complete in 90 seconds. This shows that the bleach solution is useful for a photographic colour paper of conventional silver coverage.

We claim:

1. A method of processing an imagewise exposed silver halide color photographic material, comprising:

forming a color image on said color photographic material, wherein said forming comprises treating said color photographic material in a solution comprising a color photographic developing agent; and bleaching said color photographic material directly following said forming of said color image or following an intermediate stop bath with a bleach solution having a pH in the range of from 11 inclusive down to but excluding 6, said bleach solution consisting essentially of: halide ions in a concentration of from 0.52 to 1.0 g/l, and a silver bleaching agent consisting of hydrogen peroxide or a compound which releases hydrogen peroxide.

2. A method according to claim 1, wherein said bleaching of said color photographic material directly follows said forming of said color image.

3. A method according to claim 1, wherein said bleaching of said color photographic material is carried out for 20 to 40 seconds.

4. A method according to claim 1, wherein said forming of said color image is carried out by redox amplification.

5. A method according to claim 1, wherein said color photographic material comprises a silver halide emulsion comprising more than 80% silver chloride.

6. A method according to claim 1, wherein said color photographic material has a total silver coating weight of less than 200 mg/m$^2$.

7. A method according to claim 1 wherein the halide ions are chloride ions.

* * * * *